US012612919B2

(12) United States Patent
Sun et al.

(10) Patent No.: US 12,612,919 B2
(45) Date of Patent: Apr. 28, 2026

(54) FAN FRAME ELECTRICAL CONNECTION STRUCTURE

(71) Applicant: ASIA VITAL COMPONENTS (CHINA) CO., LTD., Shenzhen (CN)

(72) Inventors: Sung-Wei Sun, Shenzhen (CN); Jing Zhu, Shenzhen (CN); Hai-Yang Xiong, Shenzhen (CN)

(73) Assignee: ASIA VITAL COMPONENTS (CHINA) CO., LTD., Shenzhen (CN)

( * ) Notice: Subject to any disclaimer, the term of this patent is extended or adjusted under 35 U.S.C. 154(b) by 432 days.

(21) Appl. No.: 18/139,946

(22) Filed: Apr. 26, 2023

(65) Prior Publication Data

US 2024/0360834 A1 Oct. 31, 2024

(51) Int. Cl.
*F04D 25/06* (2006.01)
*F04D 25/08* (2006.01)

(52) U.S. Cl.
CPC ..... *F04D 25/0693* (2013.01); *F04D 25/06* (2013.01); *F04D 25/08* (2013.01)

(58) Field of Classification Search
CPC ..... F04D 19/002; F04D 25/06–0646; F04D 25/068; F04D 25/0693; F04D 25/08; F04D 29/542–544
See application file for complete search history.

(56) References Cited

U.S. PATENT DOCUMENTS 4,160,576 A * 7/1979 Vettori ..... F04D 29/646 439/527
6,508,621 B1 * 1/2003 Zeighami ..... F04D 25/166 415/199.2
10,113,551 B2 10/2018 Taroda et al.
10,989,205 B2 * 4/2021 Lu ..... F04D 25/0653
2005/0186070 A1 * 8/2005 Zeng ..... F04D 29/544 415/211.2

(Continued)

FOREIGN PATENT DOCUMENTS

CN 209748306 U * 12/2019 ..... F04D 19/002
CN 111255715 A * 6/2020 ..... F04D 19/002

(Continued)

OTHER PUBLICATIONS

Search Report dated Apr. 26, 2023 issued by Taiwan Intellectual Property Office for counterpart application No. 111135218.

*Primary Examiner* — Alexander B Comley
(74) *Attorney, Agent, or Firm* — Demian K. Jackson; Jackson IPG PLLC

(57) ABSTRACT

A fan frame electrical connection structure includes a frame body. The frame body has a wind incoming side and a wind outgoing side. A bearing cup seat is disposed at the wind outgoing side. Multiple static blades and an enclosure static blade are integrally formed between the bearing cup seat and the frame body. A lead pin set is integrally enclosed in the enclosure static blade. The enclosure static blade has a static blade front edge and a static blade rear edge. The static blade front edge is directed to the wind incoming side and has a front edge arc. The static blade rear edge is directed to the wind outgoing side and having a rear edge arc. Accordingly, the assembling and manufacturing process of the fan can be automated and speeded and the fan can keep having its original property.

6 Claims, 2 Drawing Sheets

(56) References Cited

U.S. PATENT DOCUMENTS

| | | | | |
|---|---|---|---|---|
| 2007/0122285 | A1* | 5/2007 | Miyazawa | F04D 29/544 416/191 |
| 2011/0097226 | A1* | 4/2011 | Nakamura | F04D 25/0693 417/423.14 |
| 2013/0251559 | A1* | 9/2013 | Taroda | F04D 29/544 417/410.1 |
| 2020/0149536 | A1* | 5/2020 | Laufer | F04D 19/002 |
| 2020/0158136 | A1* | 5/2020 | Yamasaki | F04D 25/0646 |
| 2021/0018009 | A1* | 1/2021 | Hsieh | F04D 25/0693 |
| 2021/0095687 | A1* | 4/2021 | Uchino | F04D 19/002 |
| 2021/0140440 | A1* | 5/2021 | Fang | F04D 25/0613 |

FOREIGN PATENT DOCUMENTS

| | | | | | |
|---|---|---|---|---|---|
| CN | 210859281 | U | * | 6/2020 | F04D 19/002 |
| CN | 114876835 | A | | 8/2022 | |
| DE | 102017130767 | A1 | * | 6/2019 | |
| EP | 1008761 | A2 | * | 6/2000 | |
| FR | 2989730 | A1 | * | 10/2013 | F01P 5/06 |
| JP | H10299691 | A | * | 11/1998 | |
| JP | 2858368 | B2 | * | 2/1999 | |
| JP | 2009264242 | A | * | 11/2009 | |
| JP | WO2008065985 | A1 | * | 3/2010 | |
| JP | 2017184433 | A | * | 10/2017 | F04D 19/002 |
| KR | 20210153436 | A | * | 12/2021 | |
| TW | I333141 | B | * | 11/2010 | |
| TW | I391567 | B | | 4/2013 | |
| TW | M575062 | U | | 3/2019 | |
| TW | M638507 | U | | 3/2023 | |

* cited by examiner

FAN FRAME ELECTRICAL CONNECTION STRUCTURE

This application claims the priority benefit of Taiwan patent application number 11135218 filed on Sep. 16, 2022.

BACKGROUND OF THE INVENTION

1. Field of the Invention

The present invention relates generally to a fan frame, and more particularly to a fan frame electrical connection structure.

2. Description of the Related Art

A fan is an often-used system heat dissipation device. The fan is often applied to an electronic apparatus (such as a server or a computer) to forcedly dissipate the heat generated by the electronic apparatus. In general, the power supply and the circuit board for controlling the signals in the fan are electrically connected to a motherboard of the electronic apparatus via an external lead set enclosed in a skin made of insulation material. The external lead set serves to transmit signals and power between the motherboard and the circuit board in the fan.

Conventionally, the circuit board in the fan is electrically connected with the external lead set by means of manual soldering. That is, multiple lead ends of the external lead set are manually plugged into multiple soldering holes of the circuit board and then the lead ends are respectively soldered and connected in the corresponding soldering holes by means of soldering material to form soldering points. Therefore, the entire connection process between the circuit board and the external lead set is completed by means of manual soldering. In case of mass production, it costs great labor to perform such soldering process. As a result, the manufacturing and assembling time is prolonged and the manufacturing cost is increased. In addition, in the soldering process, when the lead ends of the external lead set are overheated by the soldering material, the insulation skin enclosing the external lead set is apt to soften or burn out. As a result, the lead ends of the external lead set can be hardly secured and accurately soldered in the soldering holes. Therefore, it often takes place that the soldering points have the condition of poor contact or even fake soldering. Such conditions will cause poor contact or even open-circuit between the circuit board and the external lead set. In this case, the power can be hardly stably supplied or the signals can be hardly stably transmitted. In some more serious cases, the fan will be powered off or the signal transmission will be interrupted to cause sudden failure of the fan. As a result, the electronic components (such as the central processing unit or the graphics processing unit) in the electronic apparatus will crush or damage due to overheating.

In order to solve the above problems, a prior art discloses that electrical connection wires are enclosed in a support. A second electrical contact on the circuit board is in direct contact with the first electrical contact. Accordingly, the connection process can be automated and the problem of poor contact can be avoided.

However, the support of the prior art only serves to connect with the fan frame wall and support the bearing cup seat. The support has no flow guide design. Therefore, when the fan impeller creates airflow, the wind will directly collide with the support to cause wind resistance. This will deteriorate the working performance of the fan. On the other hand, when the wind collides with the support, the wind will rebound. As a result, the forward wind and the rebounding wind will collide with each other to cause vortex and noise.

Therefore, the prior art provides a solution to the problem that the manufacturing process cannot be automated and the problem of poor contact. However, the problems of change of the property of the fan and the noise are derived from the prior art. In this field, it is an often-seen technique that the static blades are connected between the bearing cup seat and the frame wall. The static blades serve to enhance the efficiency of the dynamic blades. According to Bernoulli's principle, when the flow speed is slowed down, the pressure increases. When the fan impeller rotates to do work to air, the airflow blown from the dynamic blades can be divided into a vertical (axial) component pressure vector and a horizontal (radial) component pressure vector. Not only the vertical component pressure vector can be fully transferred, but also the direction of the horizontal component pressure vector can be changed due to design of the configuration of the static blades so as to enhance the air volume output from the fan.

In the case that the above static blade is designed without any limitation, it is quite easy to design the static blade. However, in the case that a lead pin set is enclosed in the static blade as a conductor, the static blade is thickened. This will deteriorate the working performance of the fan such as reduce the wind pressure, lower the air volume or increase the noise.

Therefore, it is tried by the applicant to provide a fan frame electrical connection structure to solve the above problems of the conventional fan that the electrical connection between the circuit board of the fan and the external lead set can be only performed by means of manual soldering and the working time and manufacturing cost are increased. Also, it is tried by the applicant to provide a fan frame electrical connection structure, which can keep the fan having its working property.

SUMMARY OF THE INVENTION

It is therefore a primary object of the present invention to provide a fan frame electrical connection structure, in which a lead pin set including multiple lead pins is integrally enclosed in an enclosure static blade by injection molding. In addition, the structure of the enclosure static blade is modified to be different from a common static blade so as to avoid deterioration of the working property of the fan.

It is a further object of the present invention to provide the above fan frame electrical connection structure, which enables the assembling and manufacturing process of the fan to be automated and speeded.

To achieve the above and other objects, the fan frame electrical connection structure of the present invention includes a frame body. The frame body has a wind incoming side and a wind outgoing side respectively disposed on two sides of the frame body. A bearing cup seat is disposed at a center of the wind outgoing side. A static blade assembly is integrally formed between an outer circumference of the bearing cup seat and an inner circumference of the frame body. The static blade set includes multiple static blades and an enclosure static blade. A lead pin set is integrally enclosed in the enclosure static blade. The enclosure static blade has an inner end connected with the outer circumference of the bearing cup seat and an outer end connected with the inner circumference of the frame body. The lead pin set includes multiple first plug ends and multiple second plug ends. The first plug ends extend from the inner end of the enclosure static blade to a bottom side of the bearing cup seat to electrically connect with a circuit board. The second plug ends extend from the outer end of the enclosure static blade to a wall section of the frame body to electrically connect with an external lead set. The enclosure static blade has a static blade front edge and a static blade rear edge. The static blade front edge is directed to the wind incoming side and has a front edge arc. The static blade rear edge is directed to the wind outgoing side and having a rear edge arc. Accordingly, the assembling and manufacturing process of the fan can be automated and speeded and the fan can keep having its original property.

By means of the design of the fan frame electrical connection structure, the assembling and manufacturing process can be automated and speeded to save labor, working time and cost. In addition, the external lead set can be electrically connected to the circuit board via the lead pin set by means of plugging/extraction without any soldering process. Moreover, the structure of the enclosure static blade is modified to compensate the fan for the loss of fan property due to that the lead pin set is enclosed in the enclosure static blade so that the fan can keep having its original property.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
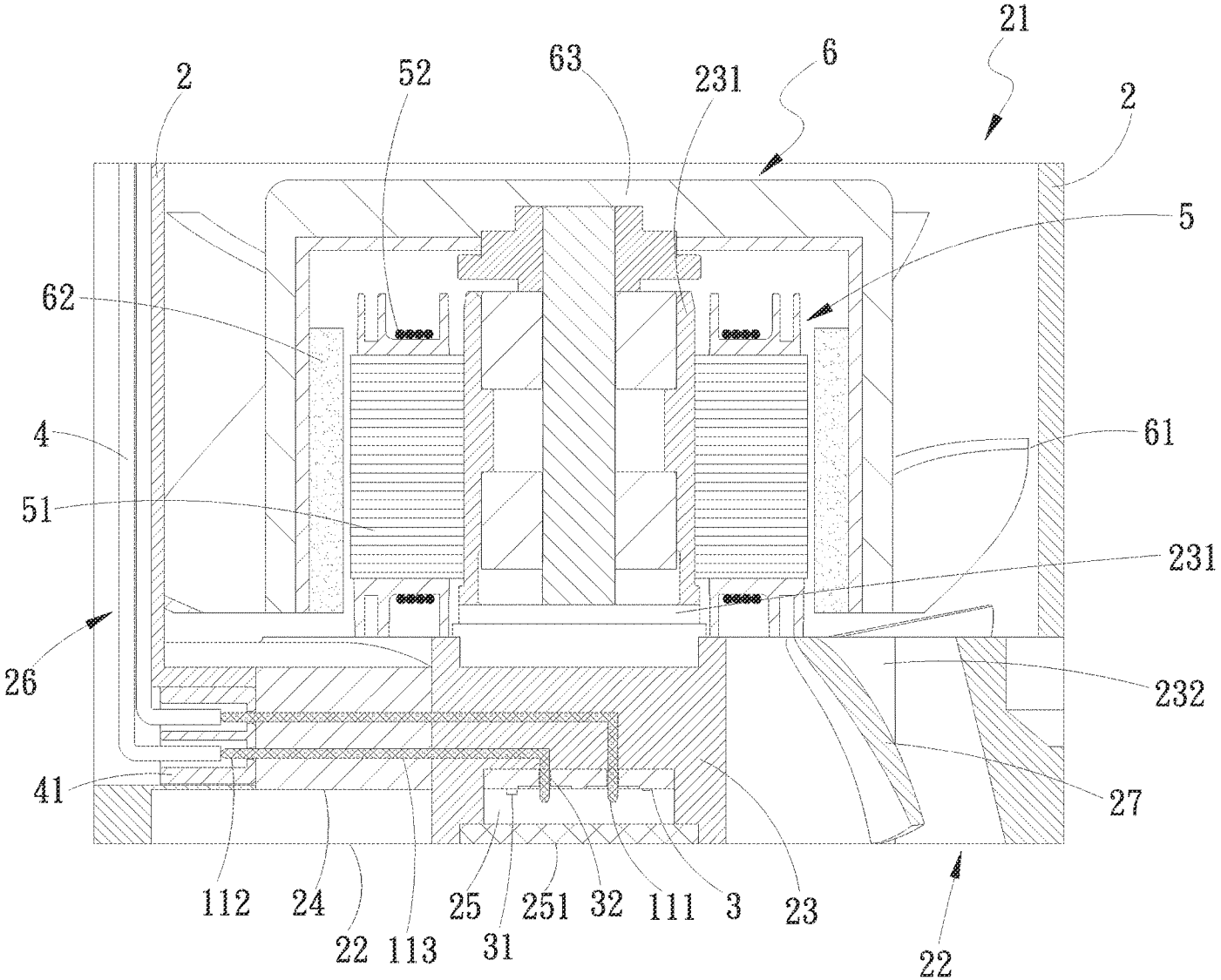
FIG. 1 is a sectional assembled view of the fan of the present invention.
Figure 2:
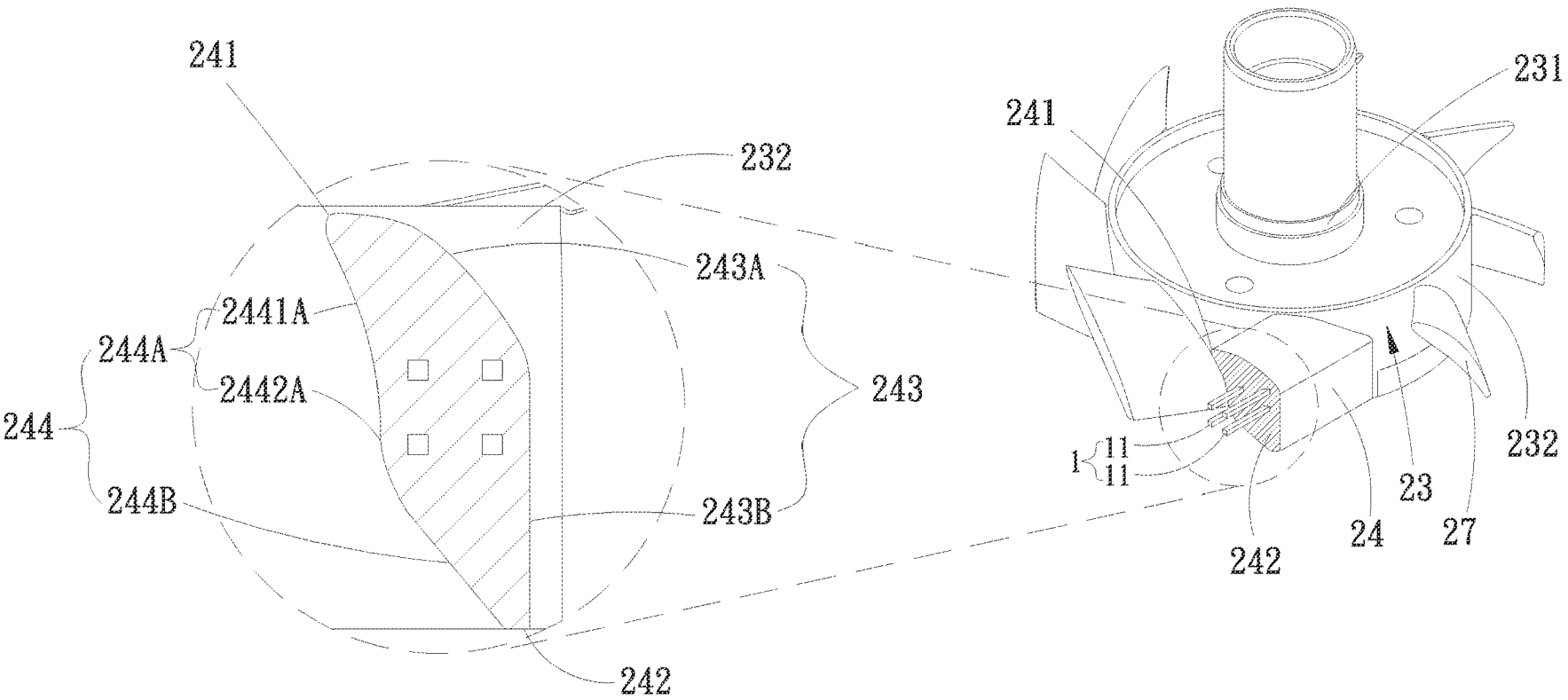
FIG. 2 is a perspective sectional view showing the bearing cup seat and the enclosure static blade of the present invention.

Please refer to FIGS. 1 and 2. The fan frame electrical connection structure of the present invention includes a lead pin set 1 and a frame body 2. The lead pin set 1 is integrally connected with the frame body 2 by injection molding. The lead pin set 1 is composed of multiple lead pins 11 made of electro-conductive metal and has multiple first plug ends 111 and multiple second plug ends 112 respectively positioned at two ends of the lead pin set 1. Each lead pin 11 has an extension section 113 integrally outward extending from the first plug end 111 of the lead pin 11 to the second plug end 112. The entire lead pin set 1 or/and all the lead pins 11 are bare electro-conductive material, that is, the lead pins 11 are not enclosed in insulation skins.

The frame body 2 has a wind incoming side 21 and a wind outgoing side 22 respectively disposed on upper and lower sides of the frame body 2. The wind incoming side 21 and the wind outgoing side 22 define therebetween a receiving space. A fan impeller 6 is received in the receiving space. The fan impeller 6 has a hub 63 and multiple blades 61 annularly disposed along an outer circumference of the hub 63. An outer side of the frame body 2 is inward recessed to form a receiving channel 26. A bearing cup seat 23 is disposed at a center of the wind outgoing side 22 of the frame body 2. An annular wall 232 upward protrudes from an outer circumference of the bearing cup seat 23. A bearing cup 231 protrudes from a center of a top side of the bearing cup seat 23. The fan impeller 6 is pivotally disposed in the bearing cup 231. A stator 5 is fitted around the bearing cup 231 corresponding to a magnetic member 62, (that is, a magnet), disposed on an inner side of the fan impeller 6. The stator 5 is magnetized by induction to rotate the fan impeller 6. The stator 5 has a silicon steel sheet assembly 51 composed of multiple stacked silicon steel sheets and a winding assembly 52 wound on the silicon steel sheet assembly 51.

Please further refer to FIGS. 1 and 2. A bottom side of the bearing cup seat 23 is recessed to form a receiving cavity 25. A circuit board 3 is received in the receiving cavity 25. Multiple electronic components 31 are arranged on the circuit board 3. Multiple lead pin connection holes are formed through the circuit board 3 and electrically connected with the electronic components 31. The electronic components 31 (such as central processing unit, transistor, etc.) are arranged on one side of the circuit board 3 and electrically connected with each other. A cover body 251 is connected with the bottom side of the bearing cup seat 23 to seal the receiving cavity 25 and prevent external humidity or salt spray from infiltrating into the receiving cavity 25 so as to protect the circuit board 3 from the corrosion of the humidity or the salt spray and achieve dustproof effect. In addition, the cover body 251 serves to effectively protect the circuit board 3 from collision and damage of alien article.

A static blade assembly is integrally formed between the outer circumference of the annular wall 232 of the bearing cup seat 23 and the inner circumference of the frame body 1. The static blade assembly includes multiple static blades 27 and an enclosure static blade 24. To speak more specifically, the static blades 27 are common static blades without enclosing any lead pin 11 therein, while the enclosure static blade 24 is a special static blade enclosing the lead pins 11 therein. The frame body 2, the bearing cup seat 23 and the static blade assembly are integrally molded with each other. The lead pin set 1 is integrally enclosed in the enclosure static blade 24. The extension sections 113 of the lead pins 11 are positioned at intervals and enclosed in thick material of the. Accordingly, the enclosure static blade 24 encloses all the lead pins 11 as an insulation skin. In this case, the lead pins 11 are electro-insulated from each other and the lead pin set 1 is protected from oxidation.

Please further refer to FIG. 1. The first plug ends 111 of the lead pin set 1, which are not enclosed in the enclosure static blade 24, barely protrude from the bottom side of the bearing cup seat 23 into the receiving cavity 25 inside the annular wall 232 of the bearing cup seat 23. The first plug ends 111 are then connected in the lead pin connection holes 32 of the circuit board 3 to electrically connect therewith. In this embodiment, all the first plug ends 111 of the lead pin set 1 can be respectively accurately plugged into all the lead pin connection holes 32 of the circuit board 3 and soldered therewith. Accordingly, the circuit board 3 is electrically connected with the first plug ends 111. The second plug ends 112 of the lead pin set 1, which are not enclosed in the enclosure static blade 24, barely protrude into the receiving channel 26 of the frame body 2 to electrically extractably connect with an electrical connector 41 of an external lead set 4. The external lead set 4 is composed of multiple external leads and connected to an external power supply and/or system circuit board. The external lead set 4 is securely received in the receiving channel 26, whereby the external lead set 4 and the electrical connector 41 are not raised from the surface of the frame body 2 so as to achieve a wire-trimming and lead protection effect.

Please further refer to FIGS. 1 and 2. To speak more specifically, the enclosure static blade 24 has a static blade front edge 241 facing the fan impeller 6 and a static blade rear edge 242 facing the wind outgoing side 22. The static blade front edge 241 has a curvature in the form of a nose, while the static blade rear edge 242 has a curvature in the form of a plane face. The curvature of the static blade front edge 241 is larger than the curvature of the static blade rear edge 242. A static blade upper surface 243 and a static blade lower surface 244 are connected between the static blade front edge 241 and the static blade rear edge 242. The static blade upper surface 243 and the static blade lower surface 244 are respectively positioned on two faces of the enclosure static blade 24. The static blade upper surface 243 is composed of an arcuate face 243A and a straight face 243B. The static blade lower surface 244 is composed of a continuous arcuate curved face 244A and an inclined face 244B.

To speak more specifically, the arcuate face 243A of the static blade upper surface 243 extends from one end of the static blade front edge 241 in an arcuate form to connect with the straight face 243B. The straight face 243B downward straightly extends to connect with one end of the static blade rear edge 242. The continuous arcuate curved face 244A of the static blade lower surface 244 downward extends from the other end of the static blade front edge 241 to connect with the inclined face 244B. The continuous arcuate curved face 244A includes a concave section 2441A and a convex section 2442A. The concave section 2441A downward extends from the static blade front edge 241 corresponding to the arcuate face 243A. The convex section 2442A continuously downward extends from the rear end of the concave section 2441A to connect with the inclined face 244B. The inclined face 244B downward obliquely straightly extends to one end of the static blade rear edge 242. The convex section 2442A and the inclined face 244B correspond to the straight face 243B.

That is, in manufacturing process of the fan frame body 2 of the present invention, the lead pin set 1 (multiple lead pins 11) is integrally directly enclosed in the enclosure static blade 24 with the first plug ends 111 and the second plug ends 112 at two ends of the lead pin set 1 extending out of the enclosure static blade 24. According to such structure, the successive components (the circuit board 3 and the electrical connector 41) can be electrically connected with each other directly by means of plugging and extraction without soldering process. Therefore, the assembling process can be automated to greatly enhance manufacturing efficiency and lower cost.

Furthermore, the lead pins 11 are directly enclosed in the enclosure static blade 24 so that the main body of the enclosure static blade 24 (between the static blade upper surface 243 and the static blade lower surface 244) is thickened. In order to compensate the enclosure static blade 24 for the loss of fan property due to the thickening of the main body, the configurations of the static blade front edge 241 and the static blade rear edge 242 at the upper and lower ends of the enclosure static blade 24 are modified. Accordingly, the curvature of the front edge arc of the static blade front edge 241 is larger than the curvature of the rear edge arc of the static blade rear edge 242 so that the thickness of a part of the enclosure static blade 24, which part is directed to the wind outgoing side 22, is reduced. This compensates the enclosure static blade 24 for the loss of fan property due to the deformation of the enclosure static blade 24 after the lead pins 1 are enclosed in the enclosure static blade 24. Therefore, the fan can keep the original property. In addition, with respect to a fan with different original property, (such as a fan with larger size or greater wind pressure), the configuration of the enclosure static blade 24 can be otherwise modified and adjusted in accordance with actual requirement. For example, the curvatures of the front edge arc and the rear edge arc can be changed or the thickness of the part of the enclosure static blade 24, which part is directed to the wind outgoing side 22, can be adjusted.

In conclusion, the present invention has the following advantages:

1. The assembling and manufacturing process can be automated.
2. The configuration of the enclosure static blade is modified to compensate the fan for the loss of fan property and restore the fan to its original property.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A fan frame electrical connection structure comprising:

a frame body having a wind incoming side and a wind outgoing side respectively disposed on two sides of the frame body, a bearing cup seat being disposed at a center of the wind outgoing side of the frame body, a static blade assembly being integrally formed between an outer circumference of the bearing cup seat and an inner circumference of the frame body, the static blade assembly including multiple static blades and an enclosure static blade, a lead pin set being integrally enclosed in the enclosure static blade, the enclosure static blade having an inner end connected with the outer circumference of the bearing cup seat and an outer end connected with the inner circumference of the frame body, the lead pin set including multiple first plug ends and multiple second plug ends, the first plug ends extending from the inner end of the enclosure static blade to a bottom side of the bearing cup seat to electrically connect with a circuit board, the second plug ends extending from the outer end of the enclosure static blade to a wall section of the frame body to electrically connect with an external lead set, the enclosure static blade having a static blade front edge and a static blade rear edge, the static blade front edge being directed to the wind incoming side and having a front edge arc, the static blade rear edge being directed to the wind outgoing side and having a rear edge arc, wherein a static blade upper surface and a static blade lower surface are connected between the static blade front edge and the static blade rear edge, the static blade upper surface being composed of an arcuate face and a straight face, the static blade lower surface being composed of a continuous arcuate curved face and an inclined face, the continuous arcuate curved face having a concave section and a convex section, the concave section extending from the static blade front edge, the convex section extending from the concave section to connect with the inclined face.

2. The fan frame electrical connection structure as claimed in claim 1, wherein a curvature of the front edge arc is larger than a curvature of the rear edge arc.

3. The fan frame electrical connection structure as claimed in claim 1, wherein the lead pin set includes multiple lead pins, each lead pin having an extension section extending from the first plug end to the second plug end, the extension sections of the lead pins being integrally enclosed in the enclosure static blade by injection molding.

4. The fan frame electrical connection structure as claimed in claim 1, wherein a bearing cup is disposed on a center of a top side of the bearing cup seat, a stator being fitted around the bearing cup, a bottom side of the bearing cup seat being recessed to form a receiving cavity, the circuit board being received in the receiving cavity, a cover body being connected with the bottom side of the bearing cup seat to seal the receiving cavity.

5. The fan frame electrical connection structure as claimed in claim 1, wherein multiple lead pin connection holes are formed through the circuit board and electrically connected with the first plug ends of the lead pins by means of plugging/extraction.

6. The fan frame electrical connection structure as claimed in claim 1, wherein the external lead set has an electrical connector, the electrical connector being electrically connected with the second plug ends of the lead pin set by means of plugging/extraction.

* * * * *